United States Patent [19]

Fremion

[11] Patent Number: 4,643,060

[45] Date of Patent: Feb. 17, 1987

[54] AIR COOLED SLOTTER AND SLITTER BLADE CUTTING EDGES

[75] Inventor: Edwin A. Fremion, Cleveland, Tenn.

[73] Assignee: Westvaco Corporation, New York, N.Y.

[21] Appl. No.: 825,447

[22] Filed: Feb. 3, 1986

[51] Int. Cl.[4] ..... B26D 7/08

[52] U.S. Cl. ..... 83/171; 83/169; 83/332; 83/664; 83/675

[58] Field of Search ..... 83/169, 171, 332, 676, 83/664, 675

[56] References Cited

U.S. PATENT DOCUMENTS

| | | | |
|---|---|---|---|
| 2,830,506 | 4/1958 | Burroughs . | |
| 3,156,274 | 11/1964 | Golick | 83/169 X |
| 3,205,732 | 9/1965 | Hutcheon et al. | 76/107 |
| 3,293,962 | 12/1966 | Gianaris | 83/470 |
| 3,583,294 | 6/1971 | Lense et al. | 83/331 X |

*Primary Examiner*—James M. Meister

*Attorney, Agent, or Firm*—W. A. Marcontell; R. L. Schmalz

[57] ABSTRACT

Labor and material costs for the maintenance and replacement of rotary slitting and slotting knives used in the conversion of corrugated paperboard are reduced by utilizing air channels behind shear knives of thin steel stampings for convective removal of heat from knife bodies.

3 Claims, 5 Drawing Figures

FIG. 1
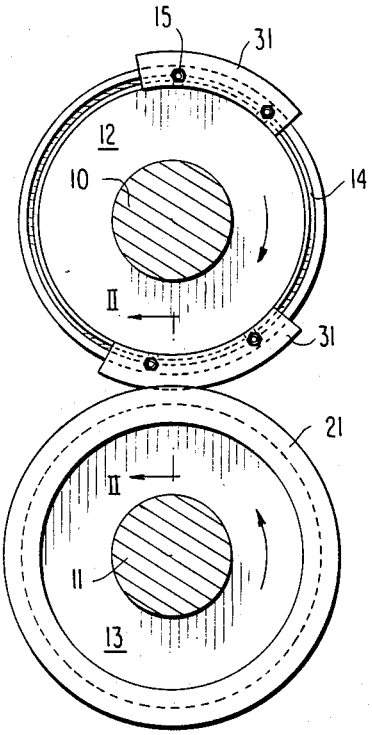
FIG. 2
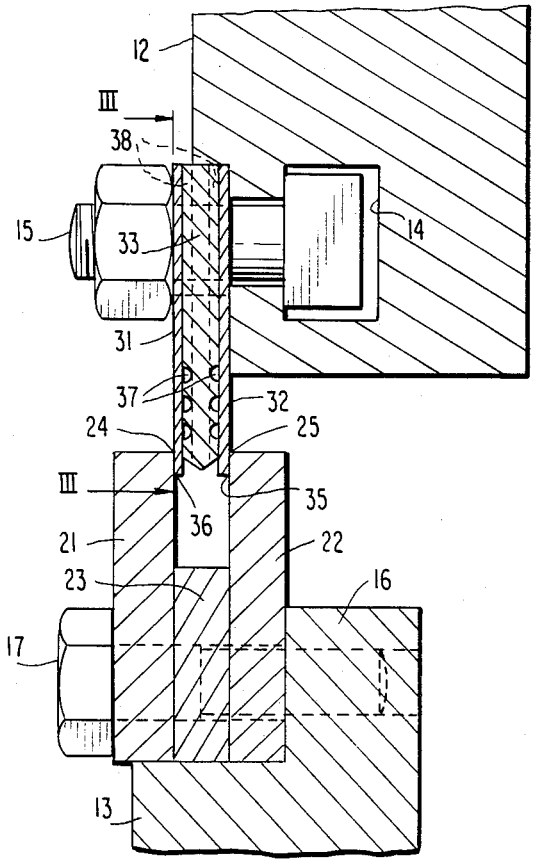
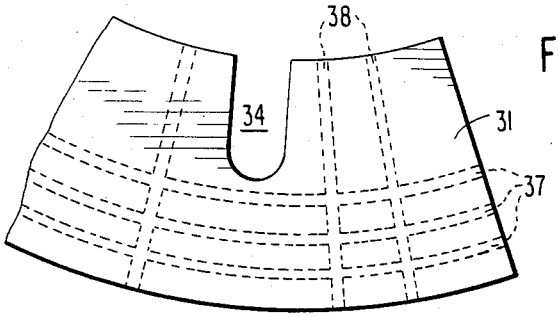
FIG. 3

AIR COOLED SLOTTER AND SLITTER BLADE CUTTING EDGES

BACKGROUND OF THE INVENTION

1. Field of the Invention

The present invention relates to rotary shear cutting of corrugated paperboard. More specifically, the invention relates to the fabrication of rotary shear knives used to slit and slot corrugated paperboard box blanks.

2. Description of the Prior Art

In the process of converting corrugated paperboard to containers of various sizes and shapes, blank sheets of the material are conveyed serially through the nips of one or more rotary cutting dies which shear strips of corrugated material to leave slot shaped voids in the sheet blanks. These slots, cut by the die engagement, define flaps which, when folded 90°, form the top and bottom container surfaces. A mere slit cut between adjacent flaps is insufficient due to physical interference between adjacent flap edges. As a general rule, such flap defining slots cut into a blank sheet are about 1/16" wide.

Due to the construction of corrugated paperboard as having parallel facing or liner sheets held together in spacial separation by an undulated medium sheet, clean and precise cuts are difficult to achieve. In those cases where crushing of the corrugated medium flutes along the cut edge is intolerable, the board may be cut by sawing. A saw-cut generated kerf, however, is wasteful of board fiber and when applied to large production rates, generates intolerable quantities of fiber dust.

More frequently, localized medium crushing along a cut perimeter may be tolerated to permit other cutting techniques. Among the other techniques is the shear die cut whereby two knife edges aligned in the same plane shear together upon the corrugated board positioned across the common plane between the knife edges. If applied to a continuous line of severance, the two knife edges may take the form of two sharp-edged discs having a slight perimeter overlap. For cutting slots and kerfs, two parallel shear planes are severed by a double edged male knife which meshes with a pair of corresponding knife edges in the form of a unitized female knife. Male and female knives of a given set are mounted on respective carrier rolls which are synchronously driven, rotatively.

Although papermakers expend considerable capital and process effort to remove foreign abrasive substances from paper pulp prior to web forming, success is achieved only in degrees less than total. Such abrasives remaining in dry paper webs are largely responsible for knife edge frictional heating and dulling which necessitates removal of the knife dies from respective carrier rolls for edge grinding. However, because of small initial meshing lap dimensions, such edge regrinding is permissible only two or three times at most before a sufficient amount of knife material is removed to prevent edge meshing.

Another cause of knife edge dulling is the customary close dimensional tolerance in the mesh fit between male and female knife edges. Zero tolerance is the desired objective. When the knives are adjusted to machine position, however, the machine is static and inoperative. Subsequent operational forces and vibrations create dynamic mismatches between respective knife edges when they are driven together. Consequent edge clashing and highly loaded, lapped sliding also generates considerable heat within the knife bodies which expand in further aggravation of the dulling result.

It is, therefore, an objective of the present invention to provide a rotary die shear design by which knife edges may be convectively air cooled.

Another object of the invention is to provide air cooled knife edges for rotary die shears that are conveniently removable and replaceable without disturbing relative machine alignments.

Another object of the invention is to provide conveniently removable knife edges that, in assembly, are intimately associated with highly convective heat transfer surfaces.

SUMMARY

These and other objects of the invention are served by rotary die shear sets having one independent cutting edge in a pair fabricated of thin, hardenable steel sheet material which is clamped by threaded fasteners tightly and intimately against a more massive, soft steel stiffening body. A matrix of channels cut below the stiffening body surface plane against which the sheet material knife is clamped, form heat conducting fins and air conduits for convective heat removal from the knife edge.

DESCRIPTION OF THE DRAWINGS

Relative to the drawings wherein like reference characters designate like or similar elements throughout the several figures of the drawings:

FIG. 1 schematically represents a slotting die embodiment of the invention;

FIG. 2 is a partial section of an operatively meshing slotting die embodiment of the invention;

FIG. 3 is a partial profile of the invention male slotting die;

DESCRIPTION OF THE PREFERRED EMBODIMENT

Figure 4:
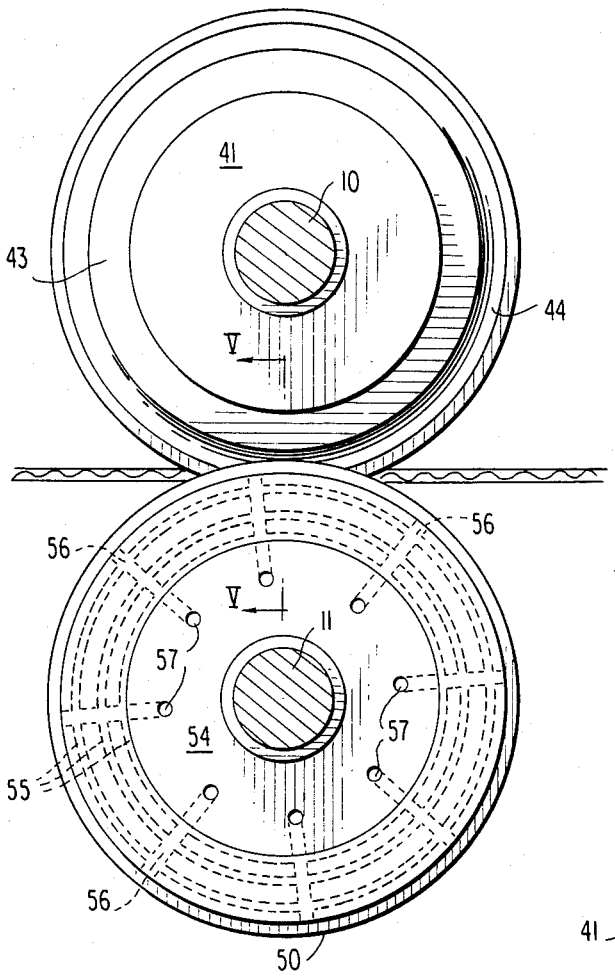
FIG. 4 schematically represents a slitting die embodiment of the invention.

As shown by FIGS. 1–3, a slotting die embodiment of the invention comprises a pair of parallel, counter rotating and synchronously driven drive shafts 10 and 11 having tool discs 12 and 13 secured thereto.

Near the radially outer rim of the upper tool disc 12 is a channel 14 for receiving T-bolts 15 therewithin. The lower tool disc 13 has a flanged rim 16 that is tapped to receive machine screws 17 which secure the female die assembly. Such assembly comprises two ring knives 21 and 22 separated by a spacer 23 having an outer diameter less than that of the ring knives. Cutting edges 24 and 25 of ring knives 21 and 22 respectively are ground to sharp, 90° angles or slightly more by hollow grinding.

The male die assembly secured by T-bolts 15 to the upper tool disc 12 is a circle segment of arcuate length equal to the objective slot length. Two assemblies are shown by FIG. 1 to be mounted on tool disc 12 as is conventional for two slot cuts per revolution of the tool disc 12. More or less as needed may be mounted. As a sheet of corrugated board is fed between the two rotating dies, meshing of the male die between the two female die cutting edges 24 and 25 shears the desired slot section from the board panel.

Compositionally, the male die assembly includes two, 0.0675 in. thick spring steel sheet blades 31 and 32 flanking opposite faces of an arcuate spacer 33. Preferably, the three component assembly of the male die is unitized by independent fasteners such as brads, rivets or counter-sunk machine screws. For ease of unit mounting to the tool disc 12, common pattern stud slots 34 are provided in all three elements of the assembly.

As with the female knife edges, the male knife edges 35 and 36 are sharply square to the plane of the respective sheet blades.

Particular attention is given to the spacer 33 between the sheet blades 31 and 33. Both faces of the spacer are grooved with a matrix of shallow slots 37 and 38. Circumferential slots 37 intersect with the radial slots 38 and both slot groups communicate openly with the atmosphere at opposite ends. As the male die knife blades 31 and 33 are heated by the clashing and sliding friction with the female die, such heat is transferred conductively to the fin area between the slots and convectively to the air within the spacer slots 37 and 38. Expansion of such heated air generates an exchange flow within the slot channels as cooler air replaces escaping hot air.

Figure 5:
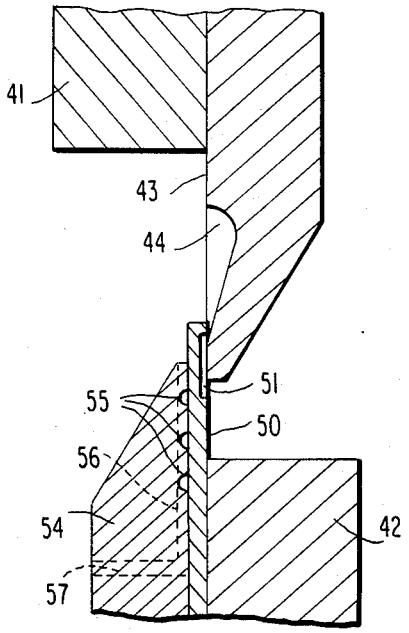
FIG. 5 is a partial section of an operatively meshing slitting die embodiment of the invention.

In the slitting die embodiment of the invention illustrated by FIGS. 4 and 5, the drive shafts 10 and 11 carry tool mounting discs 41 and 42. The upper mounting disc 41 supports a traditional or prior art disc knife 43 which is beveled on the backside and given a hollow ground annular relief cavity 44 around the front side rim.

Lower mounting disc 42 supports a two piece assembly of the present invention comprising a 1/16 inch thick spring steel sheet blade 50 fabricated with a shallow rim cavity 51 on the blade front side adjacent to the slitting plane. Supporting the thin sheet blade 50 is a stabilizer wheel 54 On the stabilizer wheel surface, near the outer rim thereof and contiguous with the sheet blade 50, are cut several circumferential, concentric grooves 55. Intersecting with the concentric grooves are a plurality of radial grooves 56. The interior terminus of each radial groove 56 is ported by a boring 57. Heat generated by the sheet blade 50 conductively transfers to the heat conducting fin structure between the grooves 55 and 56. Air in the grooves 55 and 56 draws this heat from the fins and directly from the sheet blade 50 resulting in an air expansion from the radial groove rim opening while cooler air is drawn into the labyrinth through ports 57.

For ease of unit assembly, the sheet blade 50 is secured by independent fasteners not shown to the stabilizer wheel 54. As shown by FIG. 4, a panel of corrugated board 60 is parted with a continuous slit as it is drawn into the shear nip between the chordal overlap of rotating circular knife edges.

Having fully described my invention,

I claim:

1. A rotary shear apparatus for cutting paperboard comprising at least two, rotatively driven die elements secured to respective, parallel drive shafts having shear edges passing each other rotatively in substantially the same shear plane, one of said die elements comprising the structurally clamped, contiguous assembly of a thin, sheet steel edge body and a stiffening means, said edge body sheet having parallel front and back surfaces with the front surface thereof being disposed within said cutting plane and the back surface having intimate, heat transfer contact with a channeled surface of said stiffening means, said channeled surface comprising a matrix pattern of interconnected grooves into and below the plane of said channeled surface and a corresponding pattern of heat conducting fins for transfer of heat in said edge body sheet to said stiffening means heat conducting fins and to air flow within said channel matrix.

2. An apparatus as described by claim 1 wherein said stiffening means is disposed as a spacer between two edge body sheets to form a male shear die element for spaced apart, parallel shear planes, said stiffening means having opposite parallel surfaces provided with said groove pattern for receiving heat from both of said edge body sheets.

3. An apparatus as described by claim 1 wherein said shear edges are full circle discs and said stiffening means matrix pattern includes radial and concentric circular grooves, respective to the axis of the corresponding drive shaft, said radial grooves being vented at an inner terminus by conduits bored from an opposite surface of said stiffening means and vented at an outer terminus through an outer circular rim of said stiffening means.

* * * * *